US010293451B2

(12) United States Patent
Kikuchi

(10) Patent No.: US 10,293,451 B2
(45) Date of Patent: May 21, 2019

(54) METHOD OF CALCULATING CIRCUMFERENCE AND MANUFACTURING A SPECTACLE LENS, CIRCUMFERENCE CALCULATING DEVICE AND CIRCUMFERENCE CALCULATING PROGRAM FOR USE IN PRODUCING A SPECTACLE LENS

(71) Applicant: HOYA CORPORATION, Tokyo (JP)

(72) Inventor: Yoshihiro Kikuchi, Tokyo (JP)

(73) Assignee: HOYA CORPORATION, Tokyo (JP)

( * ) Notice: Subject to any disclaimer, the term of this patent is extended or adjusted under 35 U.S.C. 154(b) by 615 days.

(21) Appl. No.: 13/846,161

(22) Filed: Mar. 18, 2013

(65) Prior Publication Data

US 2013/0260641 A1 Oct. 3, 2013

(30) Foreign Application Priority Data

Mar. 29, 2012 (JP) ..... 2012-076752

(51) Int. Cl.
*B24B 9/14* (2006.01)
*B24B 49/00* (2012.01)

(52) U.S. Cl.
CPC ..... *B24B 9/148* (2013.01); *B24B 49/00* (2013.01)

(58) Field of Classification Search
None
See application file for complete search history.

(56) References Cited

U.S. PATENT DOCUMENTS

| | | | | |
|---|---|---|---|---|
| 5,630,746 | A | 5/1997 | Gottschald et al. | |
| 5,775,973 | A * | 7/1998 | Watanabe | 451/5 |
| 2006/0276106 | A1 * | 12/2006 | Inoguchi | 451/5 |
| 2009/0268199 | A1 * | 10/2009 | Inoguchi | 356/124 |
| 2010/0002187 | A1 * | 1/2010 | Nauche | B24B 9/148 351/83 |
| 2012/0058714 | A1 * | 3/2012 | Lemaire | B24B 9/14 451/43 |

FOREIGN PATENT DOCUMENTS

EP 0890414 A2 1/1999

OTHER PUBLICATIONS

Sep. 29, 2017 Extended European Search Report issued in European Patent Application No. 13161317.6.

* cited by examiner

*Primary Examiner* — Robert E Fennema
*Assistant Examiner* — Shon G Foley
(74) *Attorney, Agent, or Firm* — Oliff PLC

(57) ABSTRACT

There is provided a circumference calculating device including an expected shape specifying part 201*b* configured to obtain an expected finish shape of a bevel in consideration of an interference amount of a beveling tool when beveling is performed to an uncut spectacle lens; and a theoretical circumference calculating part 201*d* configured to obtain a bevel circumference of the spectacle lens having the expected finish shape obtained by the expected shape specifying part 201*b*, as a theoretical circumference of this spectacle lens.

3 Claims, 7 Drawing Sheets

METHOD OF CALCULATING CIRCUMFERENCE AND MANUFACTURING A SPECTACLE LENS, CIRCUMFERENCE CALCULATING DEVICE AND CIRCUMFERENCE CALCULATING PROGRAM FOR USE IN PRODUCING A SPECTACLE LENS

BACKGROUND

Technical Field

The present invention relates to a method of calculating a circumference used when bevel edging is applied to a spectacle lens, a method of manufacturing a spectacle lens, and a circumference calculating device and a circumference calculating program.

Description of Related Art

A spectacle lens framed into a spectacle frame is formed by being subjected to an edging process applied to an uncut lens. An edging process includes "edging" for cutting and polishing the uncut lens so as to match a spectacle frame shape, and "beveling" for providing a bevel on an edged lens. When such an edging process is performed, the following situation should be prevented: namely, a lens is not framed into a spectacle frame due to an excessively large spectacle lens after edging, or a gap is generated between the spectacle lens after edging and the spectacle frame. In view of this point, conventionally a bevel circumference of the spectacle lens after edging is measured so as to match the circumference of the spectacle lens, and defect and non-defect of this spectacle lens is judged (for example, see patent documents 1 and 2), and the bevel circumference is set in a case that beveling is performed so as to match the circumference of the spectacle frame (for example, see patent documents 3 and 4).

Patent document 1: Patent Publication No. 3075870

Patent document 2: Patent Publication No. 3904212

Patent document 3:

Japanese Patent Laid Open Publication No. 1999-052306

Patent document 4:

Japanese Patent Laid Open Publication No. 2002-018686

Incidentally, when the beveling is performed to the uncut lens, an interference occurs during beveling between a beveling tool and a beveled place of the lens even at a point other than a theoretical cutting point, under an influence of a lens shape to be edged, a lens curve to be edged, and a diameter and a bevels shape of the beveling tool (cutting and polishing tool) used for the beveling, and tapering or strain, etc., is probably generated in the shape of the formed bevel. For example, a position of the beveling tool is not required to be varied in Z-axis direction unless a locus of a bevel tip in a circumferential direction (called "bevel tip locus" hereafter) is varied in the Z-axis direction (lens optical axis direction). Therefore, the tapering or the strain, etc., of the bevel shape is not generated. Meanwhile, the lens has a curve based on a prescription content, and has a variation in the bevel tip locus in the Z-axis direction in most cases. Accordingly, when the beveling is performed, the tapering or the strain, etc., is generated in the shape of the formed bevel due to the interference between the beveling tool which is displaced in the z-axis direction, and the beveled place of the lens, resulting in a situation that the bevel is not positioned at an expected position when the beveling is performed.

However, the situation that the tapering and the strain, etc., is generated in the bevel shape under the influence of the beveling tool, is not taken into consideration in a conventional technique disclosed in patent documents 1 to 4. Namely, even in a case that the tapering or the strain, etc., is actually generated in the bevel shape under the influence of the beveling tool, the bevel circumference in a case of not generating the interference, is selected as a reference. Accordingly, if the tapering or the strain, etc., is generated in the bevel shape, a deviation is generated between an expected bevel circumference and an actually obtained bevel circumference, and whether or not indicated beveling is performed, cannot be accurately judged from the actually obtained bevel circumference, which probably invites a finish size failure of the bevel edging as a result. Such a size failure is also a factor of inviting a situation that even if the beveling is performed so as to match the circumference of the spectacle frame, the spectacle lens after beveling cannot be correctly fitted into the spectacle frame. Therefore, the generation of the size failure should be prevented.

Accordingly, an object of the present invention is to provide a method of calculating a circumference, a method of manufacturing spectacle lens, a circumference calculating device and a circumference calculating program capable of improving a fitting ratio of a spectacle lens after beveling into a spectacle lens frame, and realizing a supply of a beveled spectacle lens with a stable good quality.

SUMMARY OF THE INVENTION

In order to achieve the above-described object, inventors of the present invention examine an interference between a beveling tool used for beveling and a beveled place of a lens, which is a factor of generating a tapering or a stain, etc., in a bevel shape. Generation of the interference is unavoidable if a lens curve, etc., is taken into consideration. However, an interference amount at this time can be specified based on the information which is already known in a stage of performing the beveling, such as a shape and a locus of the beveling tool, and a curve and a lens shape, etc., of the beveled lens. Therefore, when the beveling is performed, the generation of the tapering or the strain, etc., in the bevel shape is probably prevented by adjusting a beveling amount so as to thicken the bevel shape for example, while the interference amount is taken into consideration. However, when the beveling amount is thus adjusted, there is a possibility that the lens shape itself is adversely influenced, and the fitting ratio into the spectacle frame is probably further reduced.

In view of this point, the following point is focused by the inventors of the present invention: namely, an adverse influence by a deviation between an actual bevel circumference and an expected bevel circumference, can be solved not based on a general concept that the beveling amount is adjusted according to the interference amount, but based on a concept that an expected finish shape of the bevel is obtained in consideration of the interference amount of the beveling tool, and a bevel circumference corresponding to its expected finish shape is set as a theoretical circumference (simply called a "theoretical circumference" hereafter) actually obtained after beveling, and the beveling thereafter is performed with such a theoretical circumference as a reference. Namely, it is found that the fitting ratio into the spectacle frame can be improved regarding the spectacle lens after beveling, by employing an unconventional new concept of a theoretical circumference of a spectacle lens in consideration of the interference amount of the beveling tool which is a generation factor of the tapering or the strain, etc., on the assumption that the tapering or the strain, etc., of the bevel shape is unavoidable.

The present invention is provided based on such a new concept by the inventors of the present invention.

According to a first aspect of the present invention, there is provided a method of calculating a circumference, including:

obtaining an expected finish shape of a bevel in consideration of an interference amount of a beveling tool when beveling is performed to an uncut spectacle lens; and setting a bevel circumference in a spectacle lens having the expected finish shape as a theoretical circumference of the spectacle lens.

According to a second aspect of the present invention, there is provided the method of the first aspect, including:

obtaining a contact mode of a probe of a measuring machine for measuring the bevel circumference of the spectacle lens, in contact with a bevel of the spectacle lens having the expected finish shape; and obtaining the theoretical circumference of the spectacle lens based on a locus of the probe when the probe moves in a circumferential direction of the spectacle lens in contact with the bevel, as a theoretical circumference of the spectacle lens.

According to a third aspect of the present invention, there is provided the method of the second aspect, including:

obtaining the expected finish shape at each measurement point set at a plurality of places in the circumferential direction of the spectacle lens; and obtaining the contact mode of the probe, in contact with the bevel having the expected finish shape at each measurement point.

According to a fourth aspect of the present invention, there is provided a method of manufacturing a spectacle lens, including:

comparing a theoretical circumference obtained using the method of calculating a circumference described in the first, second, and third aspects, and a measured circumference obtained using a measuring machine for measuring a bevel circumference of a spectacle lens; and judging defect and non-defect of the spectacle lens after beveling.

According to a fifth aspect of the present invention, there is provided a circumference calculating device, including:

an expected shape specifying part configured to obtain an expected finish shape of a bevel in consideration of an interference amount of a beveling tool when beveling is performed to an uncut spectacle lens; and a theoretical circumference calculating part configured to obtain a bevel circumference of a spectacle lens having the expected finish shape obtained by the expected shape specifying part, as a theoretical circumference of the spectacle lens.

According to a sixth aspect of the present invention, there is provided a circumference calculating program, including a computer that functions as:

an expected shape specifying part configured to obtain an expected finish shape of a bevel in consideration of an interference amount of a beveling tool when beveling is performed to an uncut spectacle lens; and a theoretical circumference calculating part configured to obtain a bevel circumference of a spectacle lens having the expected finish shape obtained by the expected shape specifying part, as a theoretical circumference of the spectacle lens.

According to a seventh aspect of the present invention, there is provided a method of calculating a circumference, including:

specifying an expected shape for obtaining an expected finish shape of a bevel in consideration of an interference amount of a beveling tool when beveling is performed to an uncut spectacle lens;

specifying a contact mode of a probe of a measuring machine that performs a bevel circumference measurement of a spectacle lens, in contact with a bevel of the spectacle lens having the expected finish shape; and obtaining a bevel circumference of the spectacle lens having the expected finish shape, based on a locus of the probe when the probe moves in a circumferential direction of the spectacle lens in contact with the bevel, as a theoretical circumference of the spectacle lens.

According to an eighth aspect of the present invention, there is provided the method of calculating a circumference of the seventh aspect, wherein in specifying the expected shape, the expected finish shape is obtained at each measurement point set at a plurality of places in a circumferential direction of the spectacle lens, and in specifying the contact mode, the contact mode of the probe in contact with the bevel having the expected finish shape is obtained at each measurement point.

According to a ninth aspect of the present invention, there is provided a method of manufacturing a spectacle lens, including:

specifying an expected shape for obtaining an expected finish shape of a bevel in consideration of an interference amount of a beveling tool when beveling is performed to an uncut spectacle lens;

specifying a contact mode for obtaining a contact mode of a probe of a measuring machine that performs measurement of a bevel circumference of a spectacle lens, in contact with a bevel of the spectacle lens having the expected finish shape;

calculating a theoretical circumference for obtaining a bevel circumference of the spectacle lens having the expected finish shape, based on a locus of the probe when the probe moves in a circumferential direction of the spectacle lens in contact with the bevel, as a theoretical circumference of the spectacle lens;

measuring a bevel circumference of a spectacle lens that has undergone beveling, using the measuring machine; and judging defect and non-defect of a lens performed to the spectacle lens after beveling, by comparing a theoretical circumference obtained in calculating the theoretical circumference, and a measurement result obtained in measuring the circumference after beveling.

According to a tenth aspect of the present invention, there is provided a circumference calculating device, including:

an expected shape specifying part configured to obtain an expected finish shape of a bevel in consideration of an interference amount of an edging tool when beveling is performed to an uncut spectacle lens;

a contact mode specifying part configured to obtain a contact mode of a probe of a measuring machine that performs measurement of a bevel circumference of a spectacle lens, in contact with a bevel of the spectacle lens having the expected finish shape; and a theoretical circumference calculating part configured to obtain a bevel circumference of the spectacle lens having the expected finish shape, based on a locus of the probe when the probe moves in a circumferential direction of the spectacle lens in contact with the bevel, as a theoretical circumference of the spectacle lens.

According to an eleventh aspect of the present invention, there is provided a circumference calculating program including a computer that functions as an expected shape specifying part configured to obtain an expected finish shape of a bevel in consideration of an interference amount of a beveling tool when beveling is performed to an uncut spectacle lens;

a contact mode specifying part configured to obtain a contact mode of a probe of a measuring machine that performs measurement of a bevel circumference of a spectacle lens, in contact with a bevel of the spectacle lens having the expected finish shape; and a theoretical circumference calculating part configured to obtain a bevel circumference of the spectacle lens having the expected finish shape obtained by the expected shape specifying part, based on a locus of the probe when the probe moves in a circumferential direction of the spectacle lens in contact with the bevel, as a theoretical circumference of the spectacle lens.

According to the present invention, even in a case that tapering or stain, etc., is generated due to the interference of the edging tool, the fitting ratio of the spectacle lens after beveling into the spectacle frame can be improved, and supply of the spectacle lens after beveling with stable good quality can be realized.

DETAILED DESCRIPTION OF THE INVENTION

Figure 1:
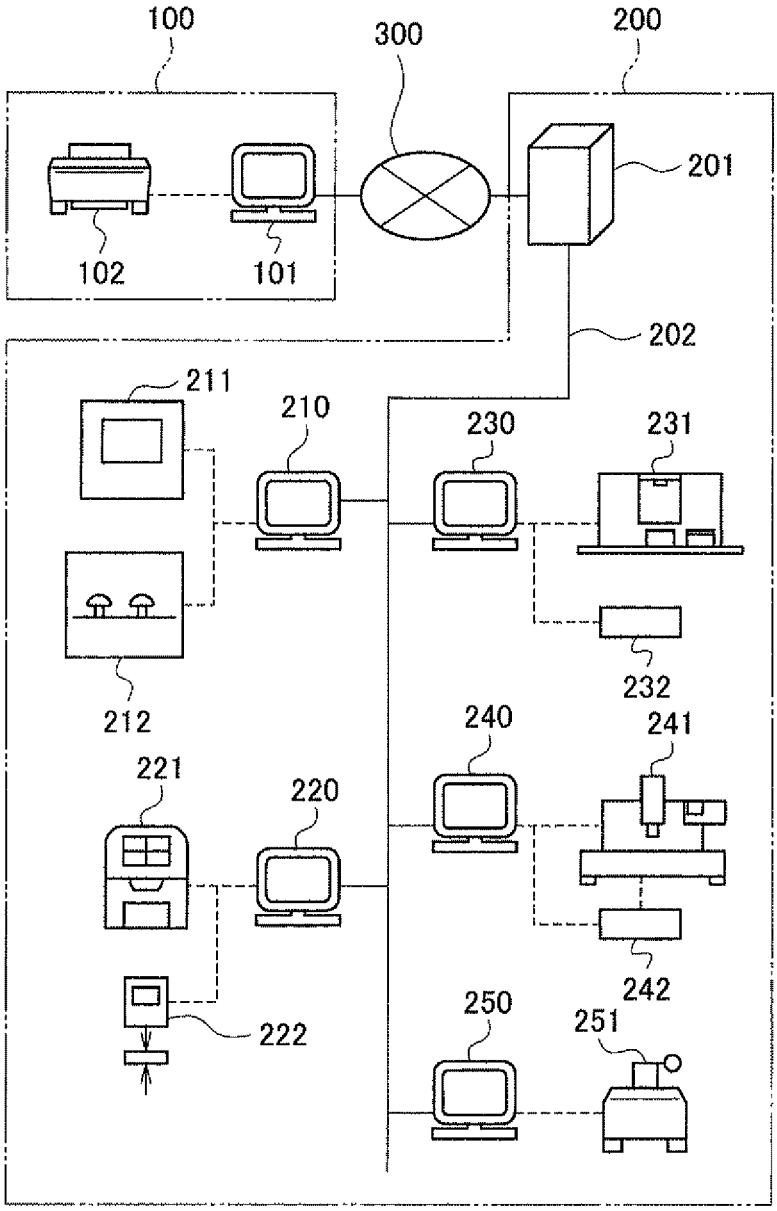
FIG. 1 is an overall block diagram of a supply system of a spectacle lens employing a method of calculating a circumference according to the present invention.

An embodiment of the present invention will be described hereafter, based on the drawings.

In this embodiment, explanation is given by classifying the contents into items in the following order.

1. System structure
2. Function structure
3. Circumference calculating procedure
4. Procedure of a method of manufacturing a spectacle lens
5. Effect of this embodiment
6. Modified example, etc.

<1. System Structure>

First, an overall structure of a system in this embodiment will be described.

FIG. 1 is an overall block diagram of a supply system of a spectacle lens employing a method of calculating a circumference according to the present invention.

(Overall Structure)

As shown in FIG. 1, the supply system of a spectacle lens given as an example according to this embodiment, has a structure in which a spectacle shop 100 being an order side of a spectacle lens, and a factory 200 of a lens manufacturer being a lens edging side, are dispersedly arranged. In the figure, although only one spectacle shop 100 is shown, actually there may be a plurality of spectacle shops 100 per one factory 200.

(Spectacle Shop Side Structure)

A terminal computer 101 for online use, and a spectacle frame measuring machine 102 for measuring a frame shape of a spectacle frame and outputting frame shape data, are installed in the spectacle shop 100.

The terminal computer 101 includes an input device such as a keyboard and a mouse, etc., and a display device such as a liquid crystal panel, etc., and is connected to the factory 200 side through a public communication line network 300, to thereby perform transmission/reception of data between the factory 200 and the terminal computer 101.

The spectacle frame measuring machine 102 is configured to make a probe brought into contact with frame grooves of right and left frames of the spectacle frame, and rotate the probe around a specific point, and three-dimensionally detect cylindrical coordinate values of a shape of the frame grooves, to thereby measure a frame shape of this spectacle frame. Then, a measurement result is outputted to the terminal computer 101 as frame shape data of this spectacle frame.

At the side of the spectacle shop 100 in which the terminal computer 101 and the spectacle frame measuring machine 102 are installed, when a prescription value, etc., of the spectacle lens, which is desired by a client, is inputted by the terminal computer 101, and when the frame shape data of the spectacle frame, which is desired by the client, is outputted to the terminal computer 101 from the spectacle frame measuring machine 102, the terminal computer 101 is configured to transmit these contents to a main frame 201 at the factory 200 side, through the public communication line network 300.

(Factory Side Structure)

Meanwhile, the main frame 201 is installed at the factory 200 side, so as to connect to the terminal computer 101 at the spectacle shop side 100 through the public communication line network 300. The main frame 201 has a function as a computer device for executing a spectacle lens edging design program and a beveling design program, etc., and is configured to perform arithmetic operation of a lens shape including a bevel shape based on the data inputted from the terminal computer 101 at the spectacle shop 100 side. Further, the main frame 201 is connected to a plurality of terminal computers 210, 220, 230, 240, 250, which are installed at the factory 200 side, via LAN 202, in addition to the public communication line network 300, so that an operation result of the lens shape is transmitted to each of the terminal computers 210, 220, 230, 240, 250.

A roughing machine (curve generator) 211 and a smoothing polishing machine 212 are connected to the terminal computer 210. Then, the terminal computer 210 controls the roughing machine 211 and the smoothing polishing machine 212 while following the operation result transmitted from the main frame 201, to thereby perform curved surface finish of a rear surface (back surface) of a front surface edged lens.

A lens meter 221 and a thickness meter 222 are connected to the terminal computer 220. Then, the terminal computer 220 compares a measurement value obtained by the lens meter 221 and the thickness meter 222, and the operation result transmitted from the main frame 201, and performs a receiving inspection of the spectacle lens that has undergone the curved surface finish of the lens rear surface (back surface), and assigns a mark (three point mark) to an accepted lens showing an optical center.

A marker 231 and an image processing machine 232 are connected to the terminal computer 230. Then, the terminal computer 230 controls the marker 231 and the image processing machine 232 while following the operation result transmitted from the main frame 201, to thereby determine a blocking position for blocking (holding) a lens when edging and beveling are performed to the spectacle lens, and assign a blocking position mark. A jig and a tool for blocking are fixed to the lens, in accordance with such a blocking position mark.

A lens edger 241 for NC-control and a chuck interlock 242 are connected to the terminal computer 240. Then, the terminal computer 240 controls the lens edger and performs edging and beveling, based on the operation result transmitted from the main frame 201.

A shape measuring device 251 measuring a top point of a bevel is connected to the terminal computer 250. Then, the terminal computer 250 controls the shape measuring device 251, to thereby cause this shape measuring device 251 to measure the circumference and the shape of the beveled spectacle lens, and compares the measurement result and the operation result transmitted from the main frame 201, to thereby judge defect and non-defect of the beveling process.

At the factory 200 side with such a structure, the main frame 201 performs arithmetic operation of a spectacle lens shape including the bevel shape, based on input data transmitted from the terminal computer 101 at eth spectacle shop 100 side, and each of the terminal computers 210, 220, 230, 240, 250 controls the lens edger 241 and the shape measuring device 251, etc., based on the operation result, to thereby manufacture the spectacle lens already beveled, with the bevel circumference matching the circumference of the spectacle frame.

In the supply system of the spectacle lens with such a structure, as will be described later in detail, the method of calculating a circumference according to the present invention is executed mainly by the main frame 201. Namely, the main frame 201 has a function as the circumference calculating device of the present invention. Further, as will be described later in detail, the method of manufacturing a spectacle lens according to the present invention is executed mainly by the main frame 201, the lens edger 241, the terminal computer 250, and the shape measuring device 251.

<2. Functional Structure>

Next, in the supply system of the spectacle lens having the above-mentioned structure, explanation will be given for a functional structure for executing the method of calculating a circumference and the method of manufacturing a spectacle lens according to the present invention.

(Lens Edger)

Here, first, explanation is given for the lens edger 241 that performs edging and beveling of the spectacle lens.

The lens edger 241 is a polishing device for NC-control having a rotating grinder for polishing to perform edging and beveling to the spectacle lens under control to move in the Y-axis direction (vertically in a spindle axis direction), and capable of performing at least 3-axis control of a rotation angle control (in a spindle axis rotating direction) of the block jig and tool to which a lens is fixed, and Z-axis control to move a grind stone or a spectacle lens in Z-axis direction (spindle axis direction) to perform beveling.

Figure 2:
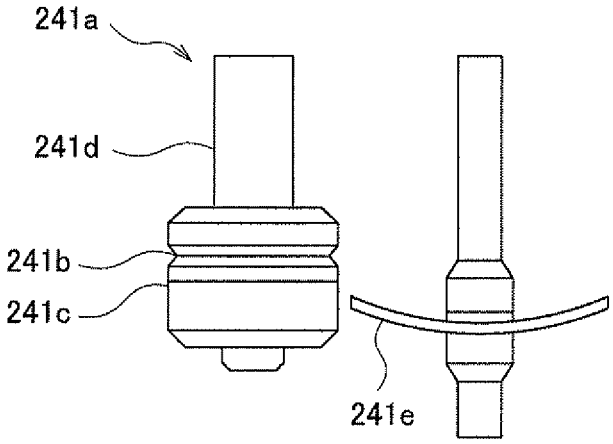
FIG. 2 is an explanatory view showing an example of a rotating grinding tool used for beveling by a lens beveling machine in the supply system of FIG. 1.

FIG. 2 is an explanatory view showing an example of the rotating grinding tool used by the lens edger 241 for the beveling process. A rotating grinding stone 241*a* shown in the figure includes a grinding stone part 241*c* having a bevel groove 241*b* formed so as to correspond to a beveling slope at the lens front surface side and a beveling slope at a lens rear surface side respectively. By moving the rotating grinding stone 241*c* along a lens circumferential edge while rotating it around a rotation axis 241*d*, the beveling is performed to an overall circumference of a spectacle lens 241*e*.

The main frame 201 calculates the locus of the movement of the rotating grinding tool 241*a* along the lens circumferential edge. The main frame 201 performs arithmetic operation of a beveling design by starting a beveling design program. Namely, based on the input data from the terminal computer 101 at the spectacle shop 100 side, the arithmetic operation of a three-dimensional beveling design is performed, to thereby calculate a shape of a final three-dimensional bevel tip, and based on such a calculated three-dimensional bevel tip shape, three-dimensional beveling locus data on a beveling coordinate is calculated, for polishing and edging the lens using the rotating grinding tool 241*a* having a prescribed radius.

However, the three-dimensional beveling locus data calculated by the main frame 201 is the data corresponding to the three-dimensional bevel tip shape, thus having a displacement in the Z-axis direction in most cases. Therefore, in the lens edger 241, if the beveling is performed based on the three-dimensional edging locus data transmitted from the main frame 201, the bevel groove of the rotating grinding tool 241*a* three-dimensionally interferes with the beveling slope estimated on data, thus probably causing a situation that the top point of the bevel that is actually beveled is smaller than estimated. Namely, in the lens edger 241, even if the beveling is performed based on the three-dimensional beveling locus data transmitted from the main frame 201, tapering or strain, etc., is generated in the shape of the formed bevel by the interference between the rotating grinding tool 241*a* that displaces in the Z-axis direction during beveling, and the beveled place, thus probably causing a situation that the bevel is not positioned at an expected position during such a beveling process. It can be said that such a generation of the tool interference is unavoidable, when a lens curve, etc., is taken into consideration.

(Shape Measuring Device)

Subsequently, explanation will be given for the shape measuring device 251 for measuring the circumference and the shape of the beveled lens.

The shape measuring device 251 includes a stylus being a probe for measuring the top point of the bevel, so that the circumference and the shape of the beveled spectacle lens is measured using the stylus.

Figure 3:
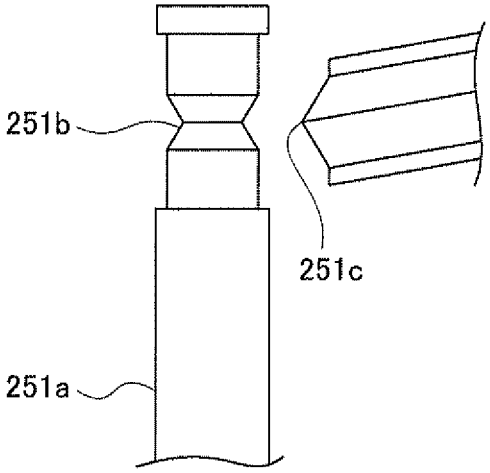
FIG. 3 is an explanatory view showing an example of a stylus provided in a shape measuring device in the supply system of FIG. 1.

FIG. 3 is an explanatory view showing an example of the stylus included in the shape measuring device 251. A stylus 251*a* shown in the figure has a contact part 251*b* provided with a V-shaped groove along a circumference so as to match the shape of a previously determined bevel, so that the contact part 251*b* is abutted on a bevel 251*c* of the beveled spectacle lens.

The shape measuring device 251 performs measurement while moving the stylus 251*a* in the circumferential direction of the lens, in a state of being abutted on the bevel 251*c* of the spectacle lens. More specifically, the stylus 251*a* is moved in a rolling state, and a three-dimensional cylindrical coordinate value of each bevel 251*c* at this time is measured. Namely, a moving distance in the lens circumferential direction, a rotation angle, and a vertical moving distance of the stylus 251*a* are measured. Then, the circumference and the shape of a virtual top point of the bevel previously defined by the stylus, is calculated from the three-dimensional cylindrical coordinate value of the measured bevel 251*c*, which are then transmitted to the terminal computer 250 as the circumference and the shape of the beveled spectacle lens.

(Functional Structure of the Main Frame and the Terminal Computer)

Subsequently, a functional structure of the main frame 201 and the terminal computer 250 will be described in detail.

Figure 4:
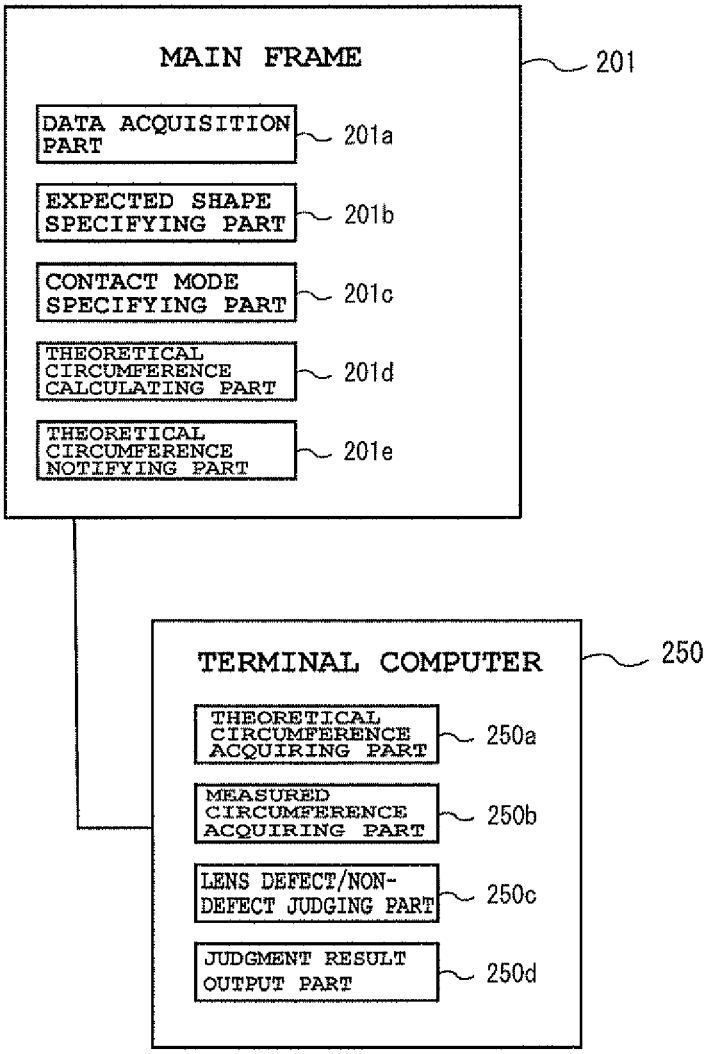
FIG. 4 is a block diagram showing a function constitutional example of a main frame in the supply system of FIG.

FIG. 4 is a block diagram showing an example of the functional structure of the main frame 201 and the terminal computer 250.

As shown in the figure, the main frame 201 has a function as a data acquisition part 201*a*, an expected shape specifying part 201*b*, a contact mode specifying part 201*c*, a theoretical circumference calculating part 201*d*, and a theoretical circumference notifying part 201*e*. Also, the terminal computer 250 has a function as a theoretical circumference acquisition part 250*a*, a measured circumference acquisition part 250*b*, a lens defect and non-defect judging part 250*c*, and a judgment result output part 250*d*. Each of the parts 201*a* to 201*e* and 250*a* to 250*d* will be sequentially described hereafter.

The data acquisition part 201*a* performs acquisition of data required for calculating the theoretical circumference as will be described later. The acquired data includes for example: data (lens curve data, etc.) for specifying a lens shape after performing edging and beveling; shape data of the rotating grinding tool 241*a* of the lens edger 241; three-dimensional beveling locus data on the edging coordinate in a case of performing cutting and polishing using the rotating grinding tool 241*a*; and shape data of the stylus 251*a* of the shape measuring device 251, and so forth. The acquisition of such data may be performed by accessing the terminal computer 101 at the spectacle shop 100 side, and the lens edger 241 and the shape measuring device 251, etc., at the factory 200 side, or may be performed by accessing a database not shown provided for collectively managing the data at the factory 200 side.

As described above, the expected shape specifying part 201*b* obtains an expected finish shape of the bevel in consideration of the interference of the beveling tool when performing the beveling, based on the data acquired by the data acquisition part 201*a*, because the generation of the tool interference is unavoidable during beveling by the lens edger 241 as described above. Namely, the shape of the bevel after the tapering or the strain, etc., is generated due to the tool interference, is obtained as the expected finish shape. Details will be described later, regarding a method of obtaining the expected finish shape.

Based on the data acquired by the data acquisition part 201*a*, the contact mode specifying part 201*c* obtains a mode of the stylus 251*a* of the shape measuring device 251 that measures the bevel circumference of the spectacle lens, in contact with the bevel of the spectacle lens having the expected finish shape obtained by the expected shape specifying part 201*b*. Namely, the contact mode of the stylus 251*a* in contact with the bevel having the expected finish shape, is obtained. Details will be described later, regarding the method of obtaining the contact mode of the stylus 251*a*.

The theoretical circumference calculating part 201*d* calculates the bevel circumference of the spectacle lens having the expected finish shape obtained by the expected shape specifying part 201*b*, and the calculation result is set as the theoretical circumference actually obtained after beveling of the spectacle lens. More specifically, the theoretical circumference of the spectacle lens having the expected finish shape is obtained, based on the locus of the stylus 251*a* in a case of moving the stylus 251*a* in the lens circumferential direction, with the stylus 251*a* in contact with the bevel having the expected finish shape. This theoretical circumference is the bevel circumference corresponding to the expected finish shape of the bevel in consideration of the interference of the beveling tool, and therefore is different from a designed bevel circumference (simply called "design circumference") calculated without considering the interference amount of the beveling tool because the beveling design program is executed. Details will be described later, regarding the method of calculating the theoretical circumference.

The theoretical circumference notifying part 201*e* notifies at least the terminal computer 250 of the theoretical circumference calculated by the theoretical circumference calculating part 201*d*.

The theoretical circumference acquisition part 250*a* acquires the theoretical circumference notified from the theoretical circumference notifying part 201*e* of the main frame 201.

When the shape measuring device 251 measures the circumference of the bevel of the beveled spectacle lens, the measured circumference acquisition part 250*b* acquires the bevel circumference being the measurement result (simply called "measured circumference" hereafter) from the shape measuring device 251.

The lens defect and non-defect judging part 250*c* compares the theoretical circumference acquired by the theoretical circumference acquisition part 250*a* and the measured circumference acquired by the measured circumference acquisition part 250*b*, to thereby judge defect and non-defect of the beveled spectacle lens. Namely, defect and non-defect of the spectacle lens whose circumference is measured, is judged by being compared with not the designed circumference but the theoretical circumference. It can be considered that judgment of defect and non-defect is performed for example in such a way that if a difference between the theoretical circumference and the measured circumference is within a previously set allowable range (for example, 1 mm or less), the spectacle lens is judged as an accepted product.

The judgment result output part 250*d* outputs a result of the judgment of defect and non-defect judged by the lens defect and non-defect judgment part 250*c*, to the main frame 201 for example.

(Circumference Calculating Program)

Each of the parts 201*a* to 201*e*, and 250*a* to 250*d* described above is realized by executing prescribed programs by the main frame 201 or the terminal computer 250 having a function as a computer device. Particularly, each of the parts 201*a* to 201*e* in the main frame 201 is realized by executing the circumference calculating program which is one of the prescribed programs. The circumference calculating program may constitute a part of the beveling design program for example, or may be different from the beveling design program, provided that it is started by the main frame 201 as needed. In any case, the circumference calculating program is used by being installed in a memory device of the main frame 210. However, prior to install, the circumference calculating program may be provided through the public communication line network 300 connected to the main frame 201, or may be provided by being stored in a memory medium that can be read by the main frame 201.

<3. Circumference Calculation Procedure>

Next, explanation will be given for a calculation procedure of the theoretical circumference performed by the main frame 201, while giving specific examples. Here, a first specific example and a second specific example are given as the specific examples.

(First Specific Example)

First, the first specific example of calculating the theoretical circumference will be described.

Figure 5:
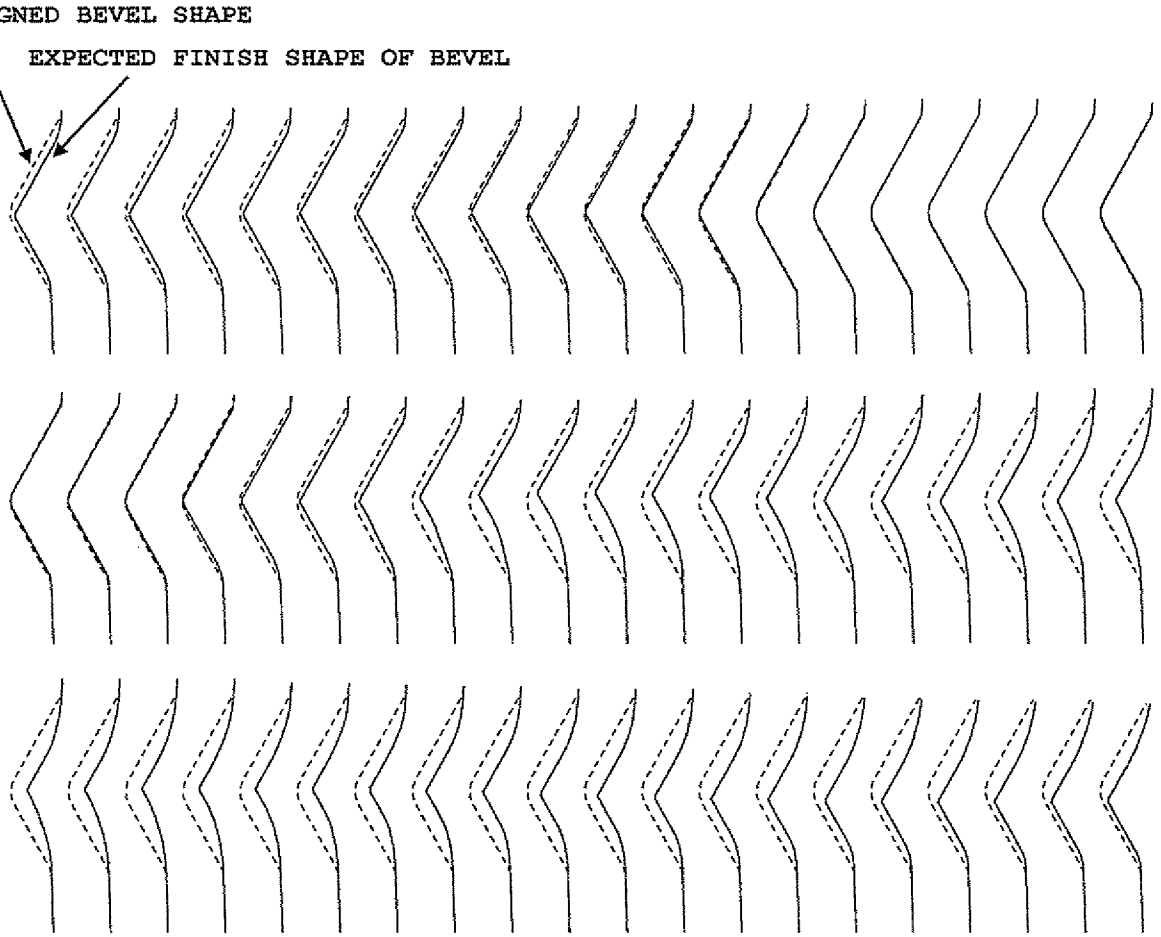
FIG. 5 is an explanatory view (view 1) showing a concept of a first specific example of calculating a theoretical circumference by a method of calculating a circumference according to the present invention.
Figure 6:
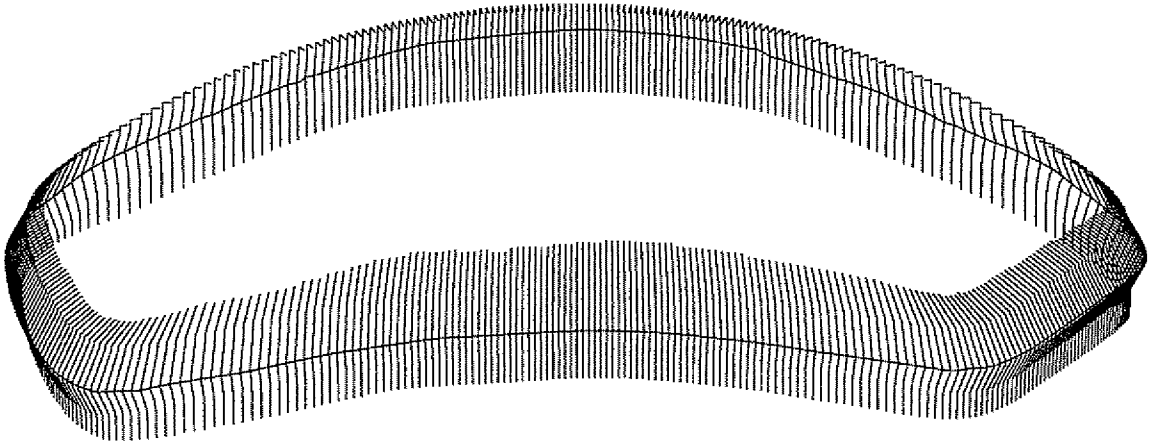
FIG. 6 is an explanatory view (view 2) showing a concept of the first specific example of calculating a theoretical circumference by the method of calculating a circumference according to the present invention.
Figure 7:
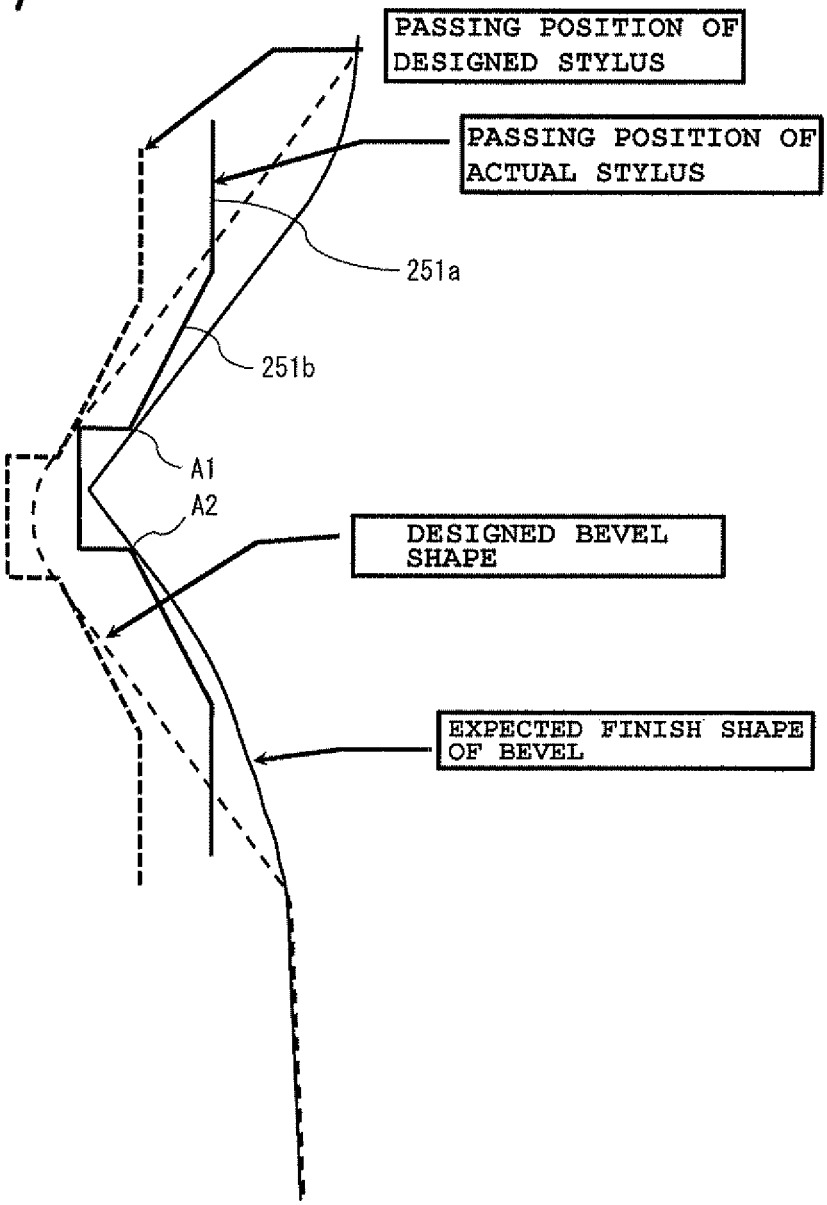
FIG. 7 is an explanatory view (view 3) showing a concept of the first specific example of calculating a theoretical circumference by the method of calculating a circumference according to the present invention.

FIG. 5 to FIG. 7 are explanatory views showing a concept of the first specific example of calculating the theoretical circumference by the method of calculating a circumference according to the present invention.

In the first specific example, the theoretical circumference is calculated through an expected shape specifying step (step 1, abbreviated as "S" hereafter), a contact mode specifying step (S2), and a theoretical circumference calculating step (S3) sequentially.

(S1; Expected Shape Specifying Step)

The expected shape specifying step (S1) is a step of obtaining the expected finish shape of the bevel by the expected shape specifying part 201*b* in consideration of the interference amount of the beveling tool. In order to obtain the expected finish shape, first, the expected shape specifying part 201*b* sets measurement points at a plurality of places in the circumferential direction of the spectacle lens. For example, the measurement points are set at 360 places obtained by dividing the circumferential direction of the spectacle lens by an angle of 1°. Then, the expected shape specifying part 201*b* estimates a sectional face parallel to the Z-axis including a beveling point on the circumferential edge of the spectacle lens, and a shape variation of the bevel on this sectional face is considered.

When the shape variation of the bevel is considered, the expected shape specifying part 201*b* focuses the beveling point on the circumferential edge of the spectacle lens on the estimated sectional face at a certain measurement point. Then, the interference amount is obtained between the rotating grinding tool 241*a* and the designed bevel shape on the estimated sectional face, which is focused, based on the locus of the beveling tool at several points to several tens of points neighboring the beveling points on the estimated sectional face, using a position of locus of the beveling tool corresponding to the beveling point on the estimated sectional face as a reference. Namely, based on the shape data and the three-dimensional beveling locus data of the rotating grinding tool 241*a*, a movement simulation of the rotating grinding tool 241*a* at a certain beveling point is performed, to thereby sequentially calculate the shape of cutting the beveling point (namely, the tool interference amount), and while utilizing an envelope curve of the shape of the sectional shape, the bevel shape after change of the shape due to the tool interference on the estimated sectional face is obtained. Such a bevel shape after change of the shape is the expected finish shape of the bevel.

A simulation process for obtaining the expected finish shape of the bevel is performed by the expected shape specifying part 201*b* at each measurement point of all measurement points as shown in FIG. 5. The expected finish shape of the bevel is different at each measurement point, because the interference amount of the rotating grinding tool 241*a* is different at each measurement point. In the figure, the shape indicated by a solid line is the expected finish shape of the bevel at each measurement point, and the shape indicated by a broken line is the shape of the bevel when the tool interference is not generated (namely a designed bevel shape).

When the expected finish shape of the bevel at each measurement point is arranged along the circumferential direction of the spectacle lens, the bevel shape in the whole body of the spectacle lens is reproduced as shown in FIG. 6. Namely, the expected finish shape of the bevel can be accurately obtained over the whole circumference of the spectacle lens.

(S2: Contact Mode Specifying Step)

The contact mode specifying step (S2) is a step of obtaining the contact mode of the stylus 251*a* in contact with the bevel having the expected finish shape, by the contact mode specifying part 201*c*. In order to obtain the contact mode of the stylus 251*a*, first based on the shape data of the stylus 251*a*, the contact mode specifying part 201*c* recognizes the sectional shape of the stylus 251*a* passing through the rotation axis. Then, after recognizing the sectional shape of the stylus 251*a*, the contact mode of the stylus 251*a* in contact with the bevel of the spectacle lens having the expected finish shape obtained by the expected shape specifying part 201*b*, is obtained at each measurement point individually where the expected finish shape is obtained. This is because the expected finish shape of the bevel at each measurement point is different, and the contact mode of the stylus 251*a* is also different at each measurement point.

In the shape measuring device 251, a constant pressure is added to the stylus 251*a*, toward a center of the spectacle lens being a measurement object. Therefore, as shown in FIG. 7, the stylus 251*a* having the contact part 251*b* with a V-shaped groove, is surely brought into contact with the bevel of the spectacle lens at two different points A1, A2 in the contact part 251*b*. By specifying a contact state at such two points A1, A2, the contact mode specifying part 201*c* obtains the contact mode of the stylus 251*a*.

Specifically, the contact mode of the stylus 251*a* is obtained by the contact mode specifying part 201*c*, by performing the following simulation process. First, the estimated sectional face at a certain measurement point is focused by the contact mode specifying part 201*c*. Then, the sectional shape of the stylus 251*a* corresponding to each estimated sectional face is made close to the expected finish shape of the bevel from a certain direction, on the estimated sectional face and on each estimated sectional face at a plurality of measurement points neighboring the estimated sectional face. Then, any one of the sectional shapes of the stylus 251*a* on each estimated sectional face, and any one of the expected finish shapes on each estimated sectional face, are surely brought into contact with each other at least at one point. At this time, if they are brought into contact with each other at one point on an upper side of the contact part 251*b* of the stylus 251*a*, this stylus 251*a* is moved by the contact mode specifying part 201*c* so that the Z-direction coordinate of the stylus 251*a* is deviated to an upper side. Also, if they are brought into contact with each other at one point at a lower side of the contact part 251*b* of the stylus 251*a*, this stylus 251*a* is moved by the contact mode specifying part 201*c* so that the Z-direction coordinate of the stylus 251*a* is deviated to the lower side. Then, after moving the stylus 251*a* by a prescribed amount, the stylus 251*a* is moved again so as to be close to the expected finish shape of the bevel. Such a process is repeatedly performed until the stylus 251*a* is brought into contact with the expected finish shape of the bevel at two points A1, A2, while gradually reducing the moving amount of the stylus 251*a*. Thus, a contact state of the stylus 251*a* in contact with the expected finish shape of the bevel at two points A1, A2, namely, the contact mode of the stylus 251*a* can be obtained.

The contact mode of the stylus 251*a* at each measurement point is individually obtained by the contact mode specifying part 201*c*, by performing such a simulation process, to all of the measurement points where the expected finish shape of the bevel is obtained. Namely, a contact state of the stylus 251*a* of the shape measuring device 251 in contact with the bevel after change of the shape is confirmed by simulation, in consideration of the change of the shape of the bevel due to the tool interference.

(S3; Theoretical Circumference Calculating Step)

The theoretical circumference calculating step (S3) is the step of obtaining the bevel circumference of the spectacle lens having the expected finish shape by the theoretical circumference calculating part 201*d*, as the theoretical circumference of the spectacle lens. It can be considered that the theoretical circumference is calculated based on the locus of the stylus 251*a* in a case of moving the stylus 251*a* in the circumferential direction of the spectacle lens, with the stylus 251*a* in contact with the expected finish shape of the bevel. Specifically, the locus of the stylus 251*a* is specified by grasping the contact mode of the stylus 251*a* at each measurement point obtained by the contact mode specifying part 201*c*, and connecting reference positions (for example, positions of a rotation center axis) of the stylus 251*a* at each measurement point in this contact mode. Then, when the locus of the stylus 251*a* is specified, the bevel circumference of the spectacle lens having the expected finish shape, namely the theoretical circumference of the spectacle lens can be obtained by using a technique (algorithm) similar to the calculation of the bevel circumference performed by the shape measuring device 251. Namely, the theoretical circumference is obtained by the theoretical circumference calculating part 201*d*, from the locus of the stylus 251*a*, based on a process content processed by the expected shape specifying part 201*b* and the contact mode specifying part 201*c*.

(Second Specific Example)

The second specific example of calculating the theoretical circumference will be described next.

In the second specific example, the theoretical circumference is calculated by performing the process through the expected shape specifying step (S4) and the theoretical circumference calculating step (S5) sequentially.

(S4; Expected Shape Specifying Step)

The expected shape specifying step (S4) is the step of obtaining the expected finish shape of the bevel in consideration of the interference amount of the beveling tool, by the expected shape specifying part 201*b* similarly to the expected shape specifying step (S1) described in the first specific example. The method of obtaining the expected finish shape of the bevel may be performed similarly to the case of the first specific example.

(S5; Theoretical Circumference Calculating Step)

The theoretical circumference calculating step (S5) is the step of obtaining the bevel circumference of the spectacle lens having the expected finish shape by the theoretical circumference calculating part 201*d*, as the theoretical circumference of the spectacle lens. However, the theoretical circumference calculating step is different from the case of the first specific example, in a point that the theoretical circumference is obtained not through the contact mode specifying step (S2) described in the first specific example.

The theoretical circumference calculating step (S5) is performed not through the contact mode specifying step (S2) unlike the case of the first specific example, and therefore the top point of the bevel in the expected finish shape of the bevel is focused and the theoretical circumference is obtained by the theoretical circumference calculating part 201*d*. Specifically, first, the top point of the bevel in the expected finish shape of the bevel at each measurement point obtained by the expected shape specifying part 201*b*, is specified. It can be considered that the top point of the bevel is specified by a procedure described below.

As an example thereof, the expected finish shape of the bevel on the estimated sectional face at each measurement point is grasped. Then, the coordinate of a top point in the expected finish shape is recognized using an extremum extracting technique for example, to thereby specify the top point of the bevel.

Further, utilization of an approximate calculation as described below, can be considered as other example.

Figure 8:
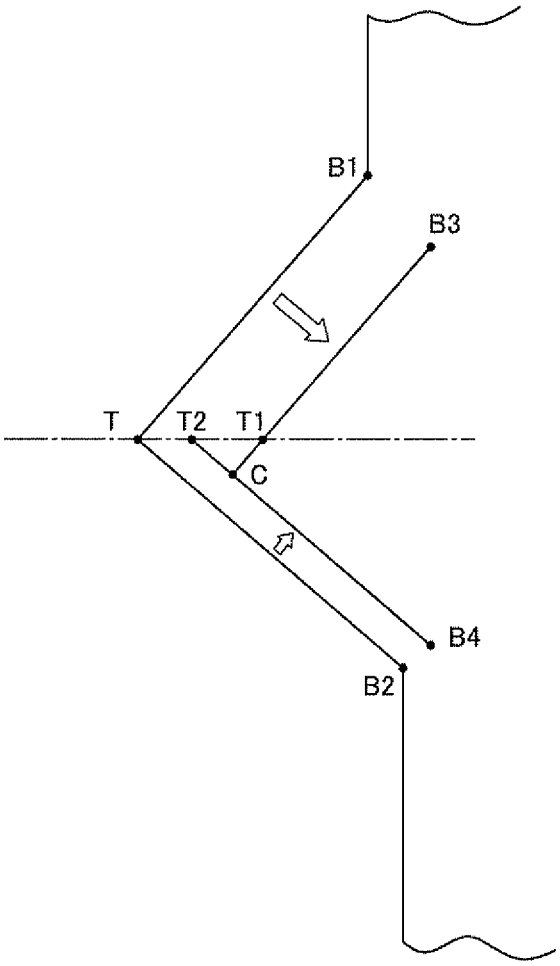
FIG. 8 is an explanatory view showing a concept of specifying a position of a top point of a bevel in a second specific example of calculating a theoretical circumference by the method of calculating circumference according to the present invention.

FIG. 8 is an explanatory view showing a concept of specifying the top point of the bevel in the second specific example of calculating the theoretical circumference by the method of calculating a circumference according to the present invention.

The top point of the bevel is specified as follows: the theoretical circumference calculating part 201*d* recognizes the designed bevel shape based on the beveling design program, on the estimated sectional face at a certain measurement point, and this designed bevel shape is divided into an upper side (namely, side T-B1 in the figure) and a lower side (namely, side T-B2 in the figure). Meanwhile, the theoretical circumference calculating part 201*d* obtains a displacement amount (namely, an amount of erosion by the interference of the beveling tool) of the upper side and the lower side, which is generated by the interference of the beveling tool. Specifically, the displacement amount of the upper side and the lower side may be obtained from a differential value between the designed bevel shape and the expected finish shape of the bevel. When the displacement amount of the upper side and the lower side is obtained, the upper side and the lower side in the designed bevel shape is moved in parallel by a portion of the displacement amount of the upper side and the lower side. Thus, an intersection point T1 of a virtual horizontal line (one dot chain line in the figure) dividing the upper side and the lower side and the upper side after movement, and an intersection point T2 of the virtual horizontal line and the lower side after movement, are specified, and further a position of a point C where the upper side and the lower side are crossed each other after movement from these intersection points T1, T2, is specified. The theoretical circumference calculating part 201*d* sets the position of point C thus obtained as the top point of the bevel on the estimated sectional face at a certain measurement point.

The approximate calculation as described above is performed by the theoretical circumference calculating part 201*d*, at all measurement points, to thereby specify the position of the top point of the bevel at each measurement point.

When the top point of the bevel at each measurement point is specified, a distance formed by connecting top points of the bevel at all measurement points on the three-dimensional coordinate space, is obtained by the theoretical circumference calculating part 201*d*, using a publicly-known geometric computation for example. Namely, the circumference at the time of connecting the top point of the bevel at each measurement point over the whole circumference, is obtained, and this circumference is set as the theoretical circumference.

By calculating the theoretical circumference by the procedure of the first specific example or the second specific example as described above, the bevel circumference after the tapering or strain, etc., which is generated in the bevel shape due to the tool interference, can be obtained, not as the designed circumference computed without considering the interference amount of the beveling tool, but as the theoretical circumference.

<4. Procedure of the Method of Manufacturing a Spectacle Lens>

The procedure (including the lens defect/non-defect judging step) of manufacturing a spectacle lens performed by the above-mentioned main frame 201 utilizing a calculation result of the theoretical circumference, will be described next.

In the method of manufacturing a spectacle lens described in this embodiment, the spectacle lens is manufactured, at least through a lens edging step (S11), an expected shape specifying step (S12), a contact mode specifying step (S13), a theoretical circumference calculating step (S14), a circumference measuring step after beveling (S15), and a lens defect/non-defect judging step (S16).

(S11; Lens Edging Step)

In the lens edging step (S11), the lens edger 241 performs edging and beveling to the spectacle lens.

(S12; Expected Shape Specifying Step to S14; Theoretical Circumference Calculating Step), In the expected shape specifying step (S12) to the theoretical circumference calculating step (S14), the theoretical circumference is obtained by the main frame 201, regarding the spectacle lens edged in the lens edging step (S11). The method of obtaining the theoretical circumference is similar to the above-mentioned expected shape specifying steps (S1, S4), the contact mode specifying step (S2), and the theoretical circumference calculating steps (S3, S5). Accordingly, as described in the second specific example of calculating the theoretical circumference, if the expected shape specifying step (S4) and the theoretical circumference calculating step (S5) are included, the contact mode specifying step (S13) may not be performed. Note that it can also be considered that the expected shape specifying step (S12) to the theoretical circumference calculating step (S14) are performed not after the lens edging step (S11), but prior to the lens edging step (S11). The theoretical circumference obtained here is transmitted to the terminal computer 250 from the main frame 201.

(S15; Post-edging Circumference Measuring Step)

In the post-edging circumference measuring step (S15), the bevel circumference is measured by the shape measuring device 251, for the beveled spectacle lens that has undergone the beveling process in the lens edging step (S11). An actual bevel circumference of the beveled spectacle lens measured by the shape measuring device 251, is transmitted to the terminal computer 250 from the shape measuring device 251, as the measured circumference.

(S16; Lens Defect/Non-defect Judging Step)

In the lens defect/non-defect judging step (S16), the lens defect/non-defect judging part 250*c* in the terminal computer 250 compares the theoretical circumference obtained in the theoretical circumference calculating step (S14) and the measurement result obtained in the post-edging circumference measuring step (S15), to thereby judge the defect/non-defect of the lens, for the beveled spectacle lens that has undergone the beveling process in the lens edging step (S11). The defect/non-defect is judged by the lens defect/non-defect judging part 250*c* as follows: for example, if the difference between the theoretical circumference and the measured circumference is within a previously set allowable range (for example 0.1 mm or less), this spectacle lens is judged as an accepted product, and if it is not within such an allowable range, this spectacle lens is judged as an unaccepted product.

Such a defect/non-defect judgment at this time is performed, not using the designed circumference, but using the theoretical circumference as a reference. Namely, the judgment is performed not based on the designed bevel shape, but based on the actual bevel shape after the tapering or the stain, etc., which is generated due to the tool interference. Accordingly, even if the deviation is generated between the designed circumference and the theoretical circumference due to an unavoidable tool interference, an adverse influence by such a deviation can be prevented from adding on the judgment of defect/non-defect for the beveled spectacle lens.

<5. Effect of this Embodiment>

According to the method of calculating a circumference, the method of manufacturing a spectacle lens, the circumference calculating device and the circumference calculating program described in this embodiment, the following effect can be obtained.

According to this embodiment, the expected finish shape of the bevel in consideration of the interference amount of the beveling tool is obtained, and the bevel circumference of the spectacle lens having the expected finish shape is set as the theoretical circumference of this spectacle lens. Namely, the bevel circumference of not the designed bevel shape, but the actual bevel shape after the tapering or the strain, etc., which is generated in the bevel shape due to the tool interference, is obtained as the theoretical circumference. Accordingly, even in a case that the tool interference is unavoidable, the bevel circumference of the bevel shape supposed to be formed actually, is obtained. Therefore, accuracy of calculating the circumference of the spectacle lens can be improved, compared with a case of not considering the tool interference, thus as a result, making it possible to solve the adverse influence due to the deviation between the designed circumference and the theoretical circumference.

Further, according to this embodiment, the contact mode of the stylus 251*a* in contact with the bevel is obtained, and based on the result thereof, the theoretical circumference is calculated. Namely, an actual contact mode is grasped, regarding the stylus 251*a* of the shape measuring device 251 that obtains the measured circumference of the beveled spectacle lens, in contact with the bevel shape after the tapering or the strain, etc., which is generated in the bevel shape due to the tool interference, and the theoretical circumference is calculated based on this grasped content. Accordingly, the calculation result of the theoretical circumference is based on the measurement result of the circumference using the stylus 251*a*. Therefore, further improvement of the accuracy is achieved in calculating the circumference of the spectacle lens, compared with a case of not using the grasped result of the contact mode of the stylus 251*a*.

Further, according to this embodiment, the theoretical circumference is calculated in such a way that measurement points are set at a plurality of places in the circumferential direction of the spectacle lens, and the expected finish shape is obtained at each measurement point, and the contact mode of the stylus 251*a* is obtained at each measurement point.

Namely, the expected finish shape is obtained, not at all places, but at each measurement point of previously set plurality of places in the circumferential direction of the spectacle lens. Then, interpolation processing is performed to a space between measurement points based on the result of each measurement point. Accordingly, although depending on the number of setting places of the measurement points, a load of an arithmetic operation for calculating the theoretical circumference can be reduced, compared with a case that the expected finish shape is obtained at all places in the circumferential direction of the spectacle lens.

Further according to this embodiment, defect/non-defect of the spectacle lens after beveling is judged in such a way that the bevel circumference in the actual bevel shape after the tapering or the strain, etc., is generated in the bevel shape due to the tool interference is obtained as the theoretical circumference, and this theoretical circumference is used as a reference. Accordingly, the adverse influence due to the deviation between the designed circumference and the theoretical circumference, which is a factor of causing a size failure of the spectacle lens after beveling, can be solved, and the fitting ratio into the spectacle frame of the spectacle lens after beveling, can be improved. Namely, even in a case that the tapering or the strain, etc., is generated in the bevel shape due to the interference of the beveling tool, the fitting ratio into the spectacle frame of the spectacle lens after beveling can be improved. As a result, the beveled spectacle lens with a stable good quality can be supplied.

Note that according to this embodiment, defect/non-defect of the spectacle lens after beveling is judged, using the theoretical circumference as a reference. Namely, the bevel circumference in the actual bevel shape after the tapering or the strain, etc., which is generated in the bevel shape due to the tool interference, is used as a reference. However, the tool interference is not generated at all places in the circumferential direction of the spectacle lens, but is generated at a part of the places. Accordingly, even in a case of using the theoretical circumference as a reference, the spectacle lens after beveling is supported by the spectacle frame mainly at a place where the tool interference is not generated, and therefore regarding such a spectacle frame, an existing product can be used as it is, without changing the reference, etc., in judging the defect/non-defect.

<6. Modified Example, Etc.>

The embodiment of the present invention is described above. The above-mentioned disclosed content shows an exemplary embodiment of the present invention. Namely, a technical scope of the present invention is not limited to the above-mentioned exemplary embodiment.

For example, the bevel shape, the shape of the rotating grinding tool 241*a*, and the shape of the stylus 251*a*, etc., given as examples of this embodiment, are simply examples, and the present invention can be applied similarly to a case of other shape.

What is claimed is:

1. A method of manufacturing a spectacle lens, the method comprising:

determining, by a simulation process, a bevel shape after change of a shape due to interference of a beveling tool for beveling an uncut spectacle lens as an expected finish shape of a bevel, the simulation process using a shape data of the beveling tool and a three-dimensional beveling locus data for beveling the spectacle lens by the beveling tool;

setting a bevel circumference in a spectacle lens having the expected finish shape as a theoretical circumference of the spectacle lens;

cutting, by the beveling tool, the spectacle lens to the determined bevel shape based on the three-dimensional beveling locus data;

determining a measured circumference of the cut spectacle lens by measuring the bevel circumference of the cut spectacle lens via a measuring machine;

comparing the theoretical circumference and the measured circumference of the cut spectacle lens; and judging whether a defect or non-defect of the cut spectacle lens is present based on the comparison of the theoretical circumference and the measured circumference of the cut spectacle lens.

2. The method of manufacturing the spectacle lens according to claim 1, further comprising:

obtaining a contact mode of a probe of a measuring machine for measuring the bevel circumference of the spectacle lens, in contact with a bevel of the spectacle lens having the expected finish shape; and obtaining the theoretical circumference of the spectacle lens based on a locus of the probe when the probe moves in a circumferential direction of the spectacle lens in contact with the bevel, as a theoretical circumference of the spectacle lens.

3. The method of manufacturing the spectacle lens according to claim 2, further comprising:

obtaining the expected finish shape at each measurement point set at a plurality of places in the circumferential direction of the spectacle lens; and obtaining the contact mode of the probe, in contact with the bevel having the expected finish shape at each measurement point.

* * * * *